United States Patent [19]

Davenport et al.

[11] Patent Number: 4,932,618

[45] Date of Patent: Jun. 12, 1990

[54] SONIC TRACK CONDITION DETERMINATION SYSTEM

[75] Inventors: Joe L. Davenport, Wildomar; Dominic L. Simard, Moreno Valley, both of Calif.

[73] Assignee: Rockwell International Corporation, El Segundo, Calif.

[21] Appl. No.: 336,361

[22] Filed: Apr. 11, 1989

[51] Int. Cl.[5] ..... G01N 29/04

[52] U.S. Cl. ..... 246/122 R; 246/120; 73/636; 180/169

[58] Field of Search ..... 246/63 R, 120, 122 R, 246/167 R, 167 D; 73/146, 634, 636; 180/167, 169; 340/901, 904, 905; 367/96

[56] References Cited

U.S. PATENT DOCUMENTS

| | | | |
|---|---|---|---|
| 2,678,559 | 5/1954 | Drake | 73/636 |
| 2,967,232 | 1/1961 | Ferm et al. . | |
| 3,112,908 | 12/1963 | Hailes . | |
| 3,234,501 | 2/1966 | Hagen et al. . | |
| 3,775,740 | 11/1973 | Douglas | 246/3 X |
| 3,817,344 | 6/1974 | Asano et al. | 180/96 |
| 3,888,437 | 6/1975 | Birkin | 246/63 A |
| 4,069,888 | 1/1978 | Wolters et al. | 367/96 X |
| 4,108,405 | 8/1978 | Gibson | 246/125 |
| 4,151,969 | 1/1979 | Wood | 246/122 R |
| 4,222,275 | 9/1980 | Sholl et al. | 73/636 |
| 4,254,418 | 3/1981 | Cronson et al. | 343/112 CA |
| 4,352,475 | 10/1982 | Smith et al. | 246/34 CT |
| 4,361,202 | 11/1982 | Minovitch | 180/168 |
| 4,434,663 | 3/1984 | Peterson et al. | 73/634 |
| 4,498,650 | 2/1985 | Smith et al. | 246/122 R |
| 4,578,665 | 3/1986 | Yang | 246/167 D X |
| 4,655,421 | 4/1987 | Jaeger | 246/167 R |
| 4,689,995 | 9/1987 | Turbe | 73/636 |

FOREIGN PATENT DOCUMENTS

| | | | |
|---|---|---|---|
| 0646178 | 8/1962 | Canada | 73/636 |
| 0659441 | 4/1979 | U.S.S.R. | 246/120 |

*Primary Examiner*—Andres Kashnikow
*Assistant Examiner*—Mark T. Le
*Attorney, Agent, or Firm*—H. Fredrick Hamann; George A. Montanye; Tom Streeter

[57] ABSTRACT

Sonic transponders mounted on a train and the track upon which it rolls transmit and receive sonic vibrations along the track. Information currently being transmitted electrically may also be thus transmitted sonically. Since the track interferes with the sonic vibration more than it does with an electrical signal, the condition of the track may also be determined.

26 Claims, 2 Drawing Sheets

SONIC TRACK CONDITION DETERMINATION SYSTEM

TECHNICAL FIELD

This invention relates to apparatus and methods for determining the condition of a railroad track between a train on the track and a point on the track distant from the train, and has particular reference to such apparatus and methods which use sonic vibrations over the track.

BACKGROUND ART

A railroad engineer needs to know the condition of the track in front of him, both as to whether it is occupied by another train, and as to whether the track itself is in condition to support a train. Considerable work has been done to transmit electrical signals along the rails between trains and transponders located in the track bed, so that the location, composition, and speed of each train can be continuously monitored by all the trains and by a centralized traffic control office. While such a system reduces the possibility of collisions between trains, it does not reduce derailments due to failure of the track itself.

SUMMARY OF INVENTION

It is an objective of the present invention to provide information to a railroad engineer or others as to the condition of the track between a train on the track and a point on the track distant from the train.

It is a feature of the present invention that sonic vibrations, rather than electrical impulses, are impressed on the rails, since such sonic vibrations are generally more affected by the condition of the track than are electrical pulses.

It is an advantage of the present invention that the information previously transmitted electrically may also be transmitted sonically, while gaining the additional information about the condition of the track.

In accordance with the present invention, apparatus is provided for determining the condition of a segment of a railroad track between a train on the track and a point on the track distant from the train. The apparatus comprises means, mounted on the train, for impressing a first sonic vibration on the track, and for receiving a second sonic vibration from the track. It further comprises means for comparing the first sonic vibration with the second sonic vibration, and means for converting the comparison of the vibrations into a determination of the condition of the track between the train and the point on the track distant from the train. The second sonic vibration generally comes about by reflection of the first sonic vibration from various inhomogeneities in the track. However, nonreflected vibrations, such as those created by other trains, switches being set or unset, and the like, are also included.

The impressing means may be the same as the receiving means, or may be different.

The impressing and receiving means may comprise a piezoelectric crystal, a solenoid, or any other means for impressing and receiving sonic vibrations on or from a track.

The present invention may also be viewed as a method for determining the condition of a segment of a railroad track between a train on the track and a point on the track distant from the train. When so viewed, it comprises four steps: (a) impressing a first sonic vibration on the track at the train; (b) receiving a second sonic vibration from the track at the train; (c) comparing the first sonic vibration with the second sonic vibration; and (d) converting the comparison of the vibrations into a determination of the condition of the track between the train and the point on the track distant from the train.

Viewed as a method, as when viewed as an apparatus, the sonic vibrations may be impressed and received by a piezoelectric crystal, a solenoid, or any other suitable apparatus.

When it is desired not to rely solely upon reflections of vibrations generated at the train, or the noise of the wheels of distant trains, transponders or other apparatus may be mounted in the track bed to receive sonic vibrations from the train and to generate responsive sonic vibrations to be received by the train. In this case, the apparatus comprises means, mounted on the train, for impressing a first sonic vibration, in a predetermined form, on the track, and for receiving a second sonic vibration from the track. It further comprises means, mounted on the track at the point on the track distant from the train, for receiving the first sonic vibration from the track, and for impressing the second sonic vibration, in a predetermined form, on the track. Means are further provided for comparing the first, the second, or both the first and second sonic vibrations as received with the corresponding sonic vibrations as predetermined. Finally, means are provided for converting the comparison of the vibration as received with the corresponding vibration as predetermined into a determination of the condition of the track between the train and the point on the track distant from the train.

The means mounted on the train for impressing a sonic vibration on the track may be the same as, or different from, the means mounted on the train for receiving a sonic vibration from the track. Likewise, the means mounted on the track for impressing a sonic vibration on the track may be the same as, or different from, the means mounted on the track for receiving sonic vibration from the track.

Comparisons may be made either between the first sonic vibration as predetermined and as actually received, or the second sonic vibration as predetermined and actually received; or both such comparisons may be made.

The impressing and receiving means may comprise a piezoelectric crystal, a solenoid, or any other means for impressing and receiving sonic vibrations on or from the track.

The track mounted sonic vibration impressing and receiving means may be conveniently powered by a solar collector.

The present invention may also be viewed as a method for determining the condition of the above-mentioned segment of track. When so viewed, it comprises 6 steps:

(a) impressing a first sonic vibration, in a predetermined form, on the track at the train;
(b) receiving the first sonic vibration from the track at the point on the track distant from the train;
(c) impressing a second sonic vibration, in a predetermined form, on the track at the point on the track distant from the train;
(d) receiving the second sonic vibration from the track at the train;

(e) comparing the first or second sonic vibration as received with the corresponding sonic vibration as predetermined; and (f) converting the comparison of the vibration as received with the corresponding vibration as predetermined into a determination of the condition of the track between the train and the point on the track distant from the train.

Viewed as a method, as when viewed as an apparatus, the comparison may be made between first sonic vibrations as received and as predetermined, second sonic vibrations as received and as predetermined, or both such comparisons may be made.

Likewise, in the method as in the apparatus, the sonic vibrations may be impressed and received by a piezoelectric crystal, a solenoid, or any other suitable apparatus.

Likewise, in the method as in the apparatus, the track mounted sonic vibration impressing and receiving means may be conveniently supplied with power from a solar collector.

PREFERRED EMBODIMENT FOR CARRYING OUT THE INVENTION

Figure 1:
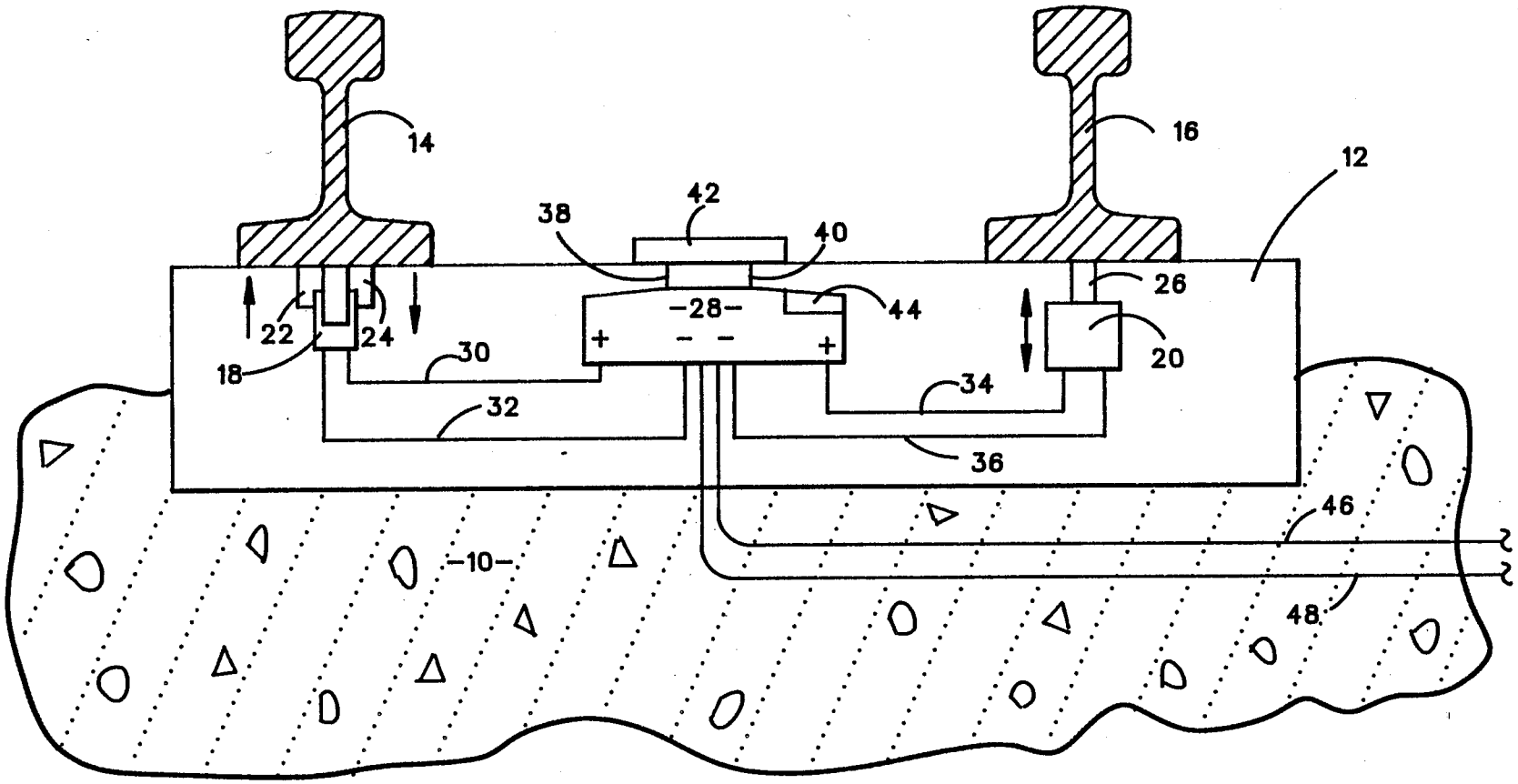
FIG. 1 shows a vertical cross-sectional view of a railroad tie, taken through the center of the tie transverse to the direction of the track, showing the solar powered track mounted transponder embedded within the tie.

Turning now to FIG. 1, the ground 10 supports a railroad tie 12. The tie 12 in turn supports two rails, a first rail 14 and a second rail 16. A first transducer 18 lies under the first rail 14, and a second transducer 20 lies under the second rail 16. The first transducer 18 is connected to the first rail 14 by separate means for impressing 22 and receiving 24 sonic vibrations upon or from the rail 14. These means may be piezoelectric crystals, solenoids, or any other suitable apparatus.

Alternatively, as is shown in the apparatus connecting the second transducer 20 with the second rail 16, a single piezoelectric crystal, solenoid, or other apparatus 26 may both impress upon, and receive from, the second rail 16 the sonic vibrations contemplated by the present invention.

The first transducer 18 and second transducer 20 are connected to a transponder 28 by connectors such as wires 30 and 32 (for first transducer 18) and wires 34 and 36 (for second transducer 20). The transponder 28 in turns receives power through connectors, such as wires 38 and 40, from a solar collector 42 mounted on the top of the tie 12, above the transponder 28.

The transponder 28 preferably includes a micro chip 44 or similar apparatus for analyzing the signals received by the transponder 28 from the transducers 18 and 20, and for determining the correct response to be made by the transponder 28 to the transducers 18 and 20. This chip 44 may be programmed in accordance with the experience developed in operating trains over the railroad track in the neighborhood of the transponder 28. It may include necessary processing apparatus to parallel the apparatus currently being used to process electrical signals being transmitted on the rails 14 and 16, and, additionally, to determine from the gross configuration of the sonic vibrations received what the sonic vibrations sent were, and to compare this gross configuration with the actual precise configuration received so as to determine the condition of the track (that is, rails 14, 16, or both) between the transponder 28 and a transponder 66 mounted on a distant train 50 (see FIG. 2). It may also include apparatus for rejecting spurious or counterfeit signals, or both. All of this information may be transmitted to a stationary control office through wires 46 and 48, or to a train by impressing suitably coded sonic vibrations upon the rails 14 and 16, or both.

Figure 2:
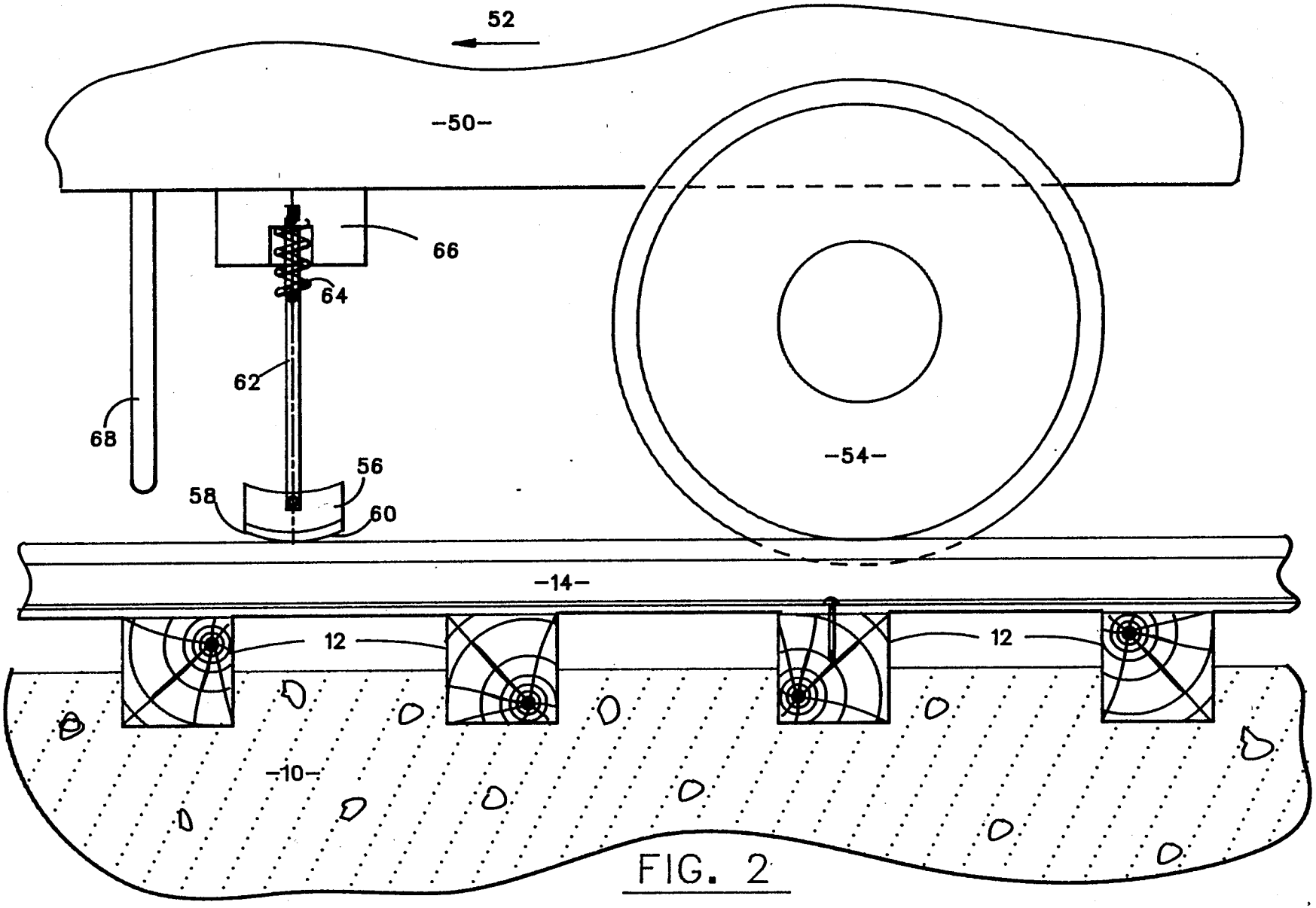
FIG. 2 is a side view of the lower front portion of a moving railroad locomotive on a railroad track, showing the train mounted sending and receiving means.

In FIG. 2, a railroad locomotive 50 moves to the left as shown by arrow 52. It rolls on a wheel 54 upon the first rail 14, supported by ties 12 and the ground 10. Forward of the wheel a sliding transducer 56, with an upwardly curving forward surface 58 and upwardly curving rear surface 60, is mounted upon a rod 62. The rod 62 is loaded by a spring 64. A transponder 66 is mounted on the train to receive signals from, and transmit signals to, the transducer 56. The general relation of the transponder 66 to the transducer 56 is similar to that of the transponder 28 to the transducers 18 or 20, and will not be described or shown in further detail. A guard plate 68 reduces the damage to the transducer 56 caused by debris on the first rail 14. In operation, the transponder 66 transmits and receives signals through the transducer 56 to or from the track 14. This sonic vibration is preferably at an ultrasound frequency, so as to avoid interference from the sound of the wheel 54 on the rail 14, which is generally of a lower frequency.

A similar wheel, transducer, and like apparatus (not shown for purpose of clarity and simplicity) interacts with the second rail 16.

No solar power collector is required on the train, since the locomotive provides ample power to operate the present invention, as well as to move the entire train.

When it is desired to rely upon reflections of sonic vibrations generated by the transponder 66, the apparatus shown in FIG. 1 may be omitted. This may be especially suitable when only gross variations of the track need to be detected. For example, rails are generally laid with a small gap between adjoining rails, so that, when the rail expands under the heat of the sun, the gap will accommodate the expansion, rather than forcing the rails to buckle. When the rails contract with the coming of nightfall, the gap re-widens.

It will be appreciated that sonic vibrations transmitted from rail to rail through the bolts which attach them together will be different from the sonic vibrations which are transmitted from rail to rail when the rails abut each other directly, as will occur on extremely hot days. It is precisely on such days that the rails are most prone to warping, and to thereby cause derailments. The reflection of sonic vibrations from the junction of two rails which abut each other, as distinct from merely being bolted together, will alert the engineer that there may be trouble ahead.

While the foregoing example is a suitable one for the use of the present invention without track mounted transponders, other applications will occur to those skilled in the art, and the present invention is not limited thereto.

Industrial Applicability

The present invention is capable of exploitation in industry by retrofitting existing tracks and/or trains with the above-described transponders, by manufacturing new tracks and/or trains with these transponders, or both. It can be made from existing components, or by more exotic components, especially the chip 44. It may be used whenever it is desired to determine the condition of a railroad track between a train and a point on the track distant from the train.

The foregoing description of a preferred embodiment of the invention should not be taken as limiting the spirit and scope of the invention. That spirit and scope are shown by the appended claims.

What is claimed is:

1. Apparatus for determining the condition of a segment of a railroad track between a train on the track and a point on the track distant from the train, the apparatus comprising:

(a) means, mounted on the train, for impressing a first sonic vibration on the track, and for receiving a second sonic vibration from the track;

(b) means for comparing the first sonic vibration with the second sonic vibration; and (c) means for converting the comparison of the vibrations into a determination of the condition of the track between the train and the point on the track distant from the train.

2. The apparatus of claim 1, wherein the impressing means and the receiving means form a single unit.

3. The apparatus of claim 1, wherein the impressing means and the receiving means form separate units.

4. The apparatus of claim 1, wherein each sonic vibration impressing and receiving means comprises a piezoelectric crystal.

5. The apparatus of claim 1, wherein each sonic vibration impressing and receiving means comprises a solenoid.

6. A method for determining the condition of a segment of a railroad track between a train on the track and a point on the track distant from the train, the method comprising:

(a) impressing a first sonic vibration on the track at the train;

(b) receiving a second sonic vibration from the track at the train;

(c) comparing the first sonic vibration with the second sonic vibration; and (d) converting the comparison of the vibrations into a determination of the condition of the track between the train and the point on the track distant from the train.

7. The method of claim 6, wherein each sonic vibration is impressed or received by means comprising a piezoelectric crystal.

8. The method of claim 6, wherein each sonic vibration is impressed or received by means comprising a solenoid.

9. Apparatus for determining the condition of a segment of a railroad track between a train on the track and a point on the track distant from the train, the apparatus comprising:

(a) means, mounted on the train, for impressing a first sonic vibration, in a predetermined form, on the track, and for receiving a second sonic vibration from the track;

(b) means, mounted on the track at the point on the track distant from the train, for receiving the first sonic vibration from the track, and for impressing the second sonic vibration, in a predetermined form, on the track;

(c) means for comparing the first or second sonic vibration as received with the corresponding sonic vibration as predetermined; and (d) means for converting the comparison of the vibration as received with the corresponding vibration as predetermined into a determination of the condition of the track between the train and the point on the track distant from the train.

10. The apparatus of claim 9, wherein the train mounted impressing means and the train mounted receiving means form a single unit.

11. The apparatus of claim 9, wherein the train mounted impressing means and the train mounted receiving means form different units.

12. The apparatus of claim 9, wherein the track mounted impressing means and the track mounted receiving means form a single unit.

13. The apparatus of claim 9, wherein the track mounted impressing means and the track mounted receiving means form different units.

14. The apparatus of claim 9, wherein the first sonic vibration as received is compared with the first sonic vibration as predetermined.

15. The apparatus of claim 9, wherein the second sonic vibration as received is compared with the second sonic vibration as predetermined.

16. The apparatus of claim 9, wherein the first sonic vibration as received is compared with the first sonic vibration as predetermined, and wherein the second sonic vibration as received is compared with the second sonic vibration as predetermined.

17. The apparatus of claim 9, wherein each sonic vibration impressing and receiving means comprises a piezoelectric crystal.

18. The apparatus of claim 9, wherein each sonic vibration impressing and receiving means comprises a solenoid.

19. The apparatus of claim 9, wherein the track mounted sonic vibration impressing and receiving means is powered by a solar collector.

20. A method for determining the condition of a segment of a railroad track between a train on the track and a point on the track distant from the train, the method comprising:

(a) impressing a first sonic vibration, in a predetermined form, on the track at the train;

(b) receiving the first sonic vibration from the track at the point on the track distant from the train;

(c) impressing a second sonic vibration, in a predetermined form, on the track at the point on the track distant from the train;

(d) receiving the second sonic vibration from the track at the train;

(e) comparing the first or second sonic vibration as received with the corresponding sonic vibration as predetermined; and (f) converting the comparison of the vibration as received with the corresponding vibration as predetermined into a determination of the condition of the track between the train and the point on the track distant from the train.

21. The method of claim 20, wherein the first sonic vibration as received is compared with the first sonic vibration as predetermined.

22. The method of claim 20, wherein the second sonic vibration as received is compared with the second sonic vibration as predetermined.

23. The method of claim 20, wherein the first sonic vibration as received is compared with the first sonic vibration as predetermined, and wherein the second sonic vibration as received is compared with the second sonic vibration as predetermined.

24. The method of claim 20, wherein each sonic vibration is impressed or received by means comprising a piezoelectric crystal.

25. The method of claim 20, wherein each sonic vibration is impressed or received by means comprising a solenoid.

26. The method of claim 20, further comprising the step of supplying power from a solar collector to a track mounted sonic vibration impressing and receiving means.

* * * * *